US006412235B1

(12) United States Patent
Pylant

(10) Patent No.: US 6,412,235 B1
(45) Date of Patent: Jul. 2, 2002

(54) REMOVABLE SCREW-TYPE, IN-GROUND ANCHOR DEVICE

(76) Inventor: Joseph T. Pylant, 637 Silverstone, Richardson, TX (US) 75083-1132

( * ) Notice: Subject to any disclaimer, the term of this patent is extended or adjusted under 35 U.S.C. 154(b) by 0 days.

(21) Appl. No.: 09/658,431

(22) Filed: Sep. 8, 2000

(51) Int. Cl.[7] ..... E02D 5/80; E21B 10/44

(52) U.S. Cl. ..... 52/155; 52/157; 52/749.1; 52/720.1; 175/323

(58) Field of Search ..... 52/155, 157, 158, 52/161, 162, 740.5, 749.1, 720.1; 411/387.1, 386, 387.4, 387.6; 175/323, 327, 385, 388, 19; D8/387

(56) References Cited

U.S. PATENT DOCUMENTS

| | | | | |
|---|---|---|---|---|
| 3,952,523 | A | 4/1976 | Gale | 61/39 |
| 4,096,677 | A | 6/1978 | Gilb | 52/297 |
| 4,239,419 | A | 12/1980 | Gillen | 405/232 |
| 4,251,963 | A | 2/1981 | Patterson | 52/157 |
| 4,320,608 | A | 3/1982 | Deike | 52/165 |
| 4,389,034 | A | 6/1983 | Suttles | 248/49 |
| 4,492,493 | A | 1/1985 | Webb | 405/172 |
| 4,593,872 | A | 6/1986 | Svensson | 248/156 |
| 4,653,245 | A | 3/1987 | Webb | 52/749 |
| 4,702,047 | A | 10/1987 | Stokes | 52/156 |
| 4,742,656 | A | 5/1988 | Farmer | 52/155 |
| 4,778,142 | A | 10/1988 | Roba | 248/545 |
| 4,803,812 | A | 2/1989 | Alexander | 52/157 |
| 4,832,304 | A | 5/1989 | Morgulis | 248/533 |
| 4,920,897 | A | 5/1990 | Reed et al. | 108/150 |
| 4,923,165 | A | 5/1990 | Cockman | 248/545 |
| 4,979,341 | A | 12/1990 | Norman et al. | 52/157 |
| 5,011,107 | A | 4/1991 | Reece | 248/545 |
| 5,066,168 | A | 11/1991 | Holdeman | 405/249 |
| 5,113,626 | A | 5/1992 | Seider et al. | 52/157 |
| 5,224,310 | A | 7/1993 | Edwards et al. | 52/165 |
| 5,295,766 | A | 3/1994 | Tiikkainen | 405/232 |
| 5,408,788 | A | 4/1995 | Hamilton et al. | 52/157 |
| 5,575,122 | A | 11/1996 | Hamilton et al. | 52/157 |
| 5,649,690 | A | 7/1997 | Kilmer | 256/35 |
| 5,662,304 | A | 9/1997 | McDaniel | 248/499 |
| 5,697,600 | A | 12/1997 | Fingerson et al. | 256/64 |
| 5,904,447 | A | 5/1999 | Sutton et al. | 405/263 |
| 5,934,836 | A | 8/1999 | Rupiper et al. | 405/244 |
| 6,032,880 | A | 3/2000 | Verrlls et al. | 240/530 |
| 6,058,662 | A | 5/2000 | Perko | 52/157 |
| 6,321,861 | B1 * | 11/2001 | Leichter | 175/323 |

* cited by examiner

*Primary Examiner*—Carl D. Friedman
*Assistant Examiner*—Jennifer I. Thissell
(74) *Attorney, Agent, or Firm*—Steven W. Smith

(57) ABSTRACT

A screw-type, in-ground anchor device for anchoring an above-ground upright. A generally cylindrical drive shaft includes an upper cylindrical housing portion constructed of ¼-inch rolled steel with an inside diameter sized to match the outside diameter of the upright. A conical portion connects the upper housing portion to a lower tip portion. The surface of the conical portion has a slope of less than 20 degrees, and preferably in the range of 5–10 degrees. A set of screw threads (flightings) are attached to the tip portion and have a diameter that is approximately equal to or less than the diameter of the upper housing portion. The flightings operate in soil to screw the anchor device into the ground when the device is rotated. The conical portion outwardly compresses the soil that is disrupted in the wake of the flightings. Since the flightings have a diameter approximately equal to or less than the diameter of the upper housing portion, soil surrounding the drive shaft is not disrupted. Therefore, the outward compression of the soil creates a tightly compressed soil shaft having the same diameter as the housing portion.

16 Claims, 4 Drawing Sheets

REMOVABLE SCREW-TYPE, IN-GROUND ANCHOR DEVICE

BACKGROUND OF THE INVENTION

1. Technical Field of the Invention

This invention relates to an apparatus and method of anchoring uprights in the ground and, more particularly, to a removable screw-type, in-ground anchor device that provides a secure foundation for uprights in any type of soil without using concrete.

2. Description of Related Art

At present, most uprights such as fence posts and sign posts are anchored in the earth by digging or drilling a hole in the ground, pouring concrete in the hole, and securing the base of the upright in the concrete until it dries. The process is tedious, labor intensive, and causes additional delays due to the drying and curing time of the concrete. Additionally, the uprights are extremely difficult or impossible to remove if the fence or sign post needs to be taken down or repositioned at a future date.

Past attempts to improve the foundation and anchoring of uprights have met with only limited success. A typical attempt is described in U.S. Pat. No. 5,295,766 to Tiikkainen. Tiikkainen discloses a foundation for uprights that includes a tubular drive-shaft that is equipped with a large helical auger at the base. In operation, a conical section above the auger serves to compact a soil layer softened by the rotation of the helical auger. However, the diameter of the auger is much greater than the widest diameter of the conical section and the outside diameter of the tubular drive-shaft. Therefore, the auger softens the soil surrounding the drive-shaft for a considerable distance beyond the outside diameter of the shaft. The conical section is then unable to compact the soil sufficiently to provide a secure foundation for the upright. Additional steps such as pouring concrete must be taken to reinforce the foundation. Thus, the soil conditions in which Tiikkainen can operate are limited, and Tiikkainen does not teach or suggest a screw-type, in-ground anchor device that provides a secure foundation for uprights without the use of reinforcing concrete.

In order to overcome the disadvantage of existing solutions, it would be advantageous to have a removable screw-type, in-ground anchor device that provides a secure foundation for uprights such as fence posts, sign posts, and street lights in any type of soil without using concrete. The present invention provides such a device.

SUMMARY OF THE INVENTION

In one aspect, the present invention is a removable screw-type, in-ground anchor device that provides a secure foundation for uprights such as fence posts, sign posts, and street lights in any type of soil without the necessity of using concrete. The anchor device includes a generally cylindrical drive shaft with a set of screw threads (flightings) mounted near the lower end. The drive shaft includes a cylindrical housing portion of a first diameter at an upper end of the drive shaft for supporting the above-ground upright. A shallow-sloped conical portion connects the housing portion to a tip portion that has a second diameter substantially less than the first diameter. The conical portion has a surface with a diameter that decreases from the first diameter to the second diameter over a longitudinal distance that provides a slope to the surface of less than 20 degrees, and preferably in the range of 5–10 degrees. The flightings are attached to the tip portion and have a third diameter that is approximately equal to the first diameter. The flightings operate in soil to screw the anchor device into the ground when the device is rotated.

In another aspect, the present invention is a screw-type, in-ground anchor device for anchoring an above-ground upright in all types of soil. The anchor device includes a cylindrical upper housing portion with a diameter sized to accept the above-ground upright. A set of flightings are mounted near a bottom end of the anchor device, and impart downward force on the anchor device when the anchor device is rotated. The flightings having a diameter approximately equal to or less than the diameter of the housing portion. The flightings disrupt the soil in their wake, and a conical portion having a slope of less than 20 degrees, and preferably in the range of 5–10 degrees, outwardly compresses the soil in the wake of the flightings. The outward compression of the soil creates a tightly compressed soil shaft having the same diameter as the housing portion.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

Figure 1A:
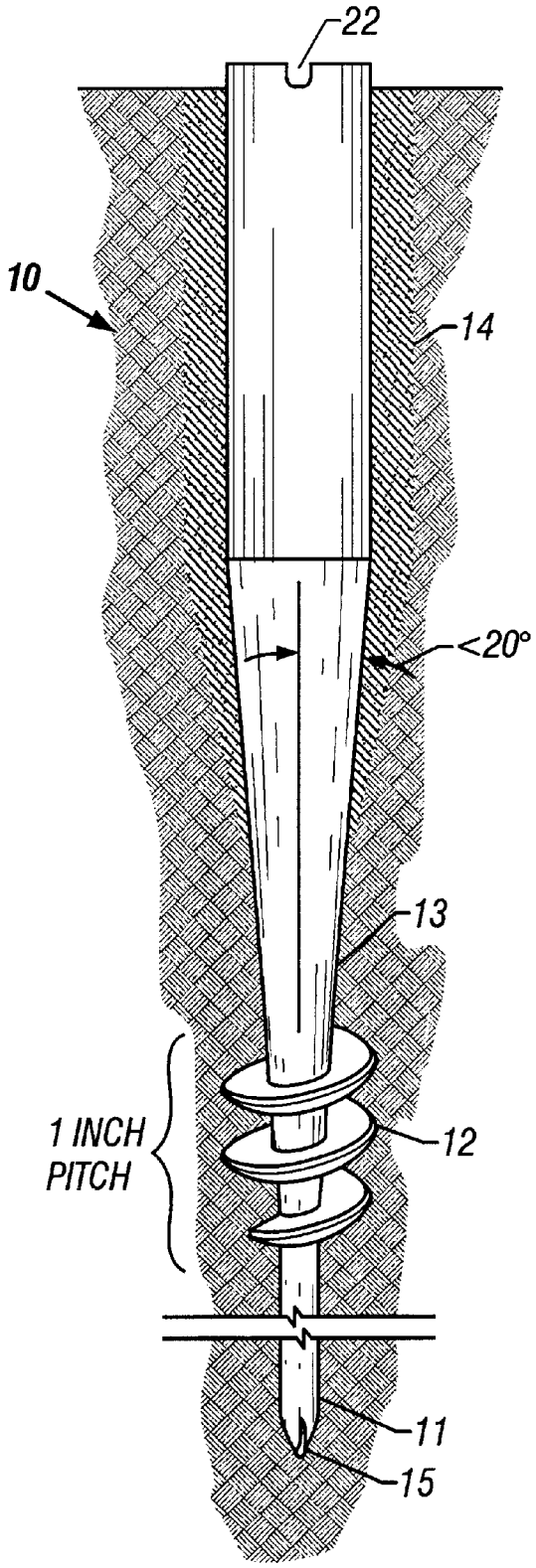
FIG. 1 is an elevational view of the preferred embodiment of the screw-type, in-ground anchor device of the present invention.
Figure 1B:
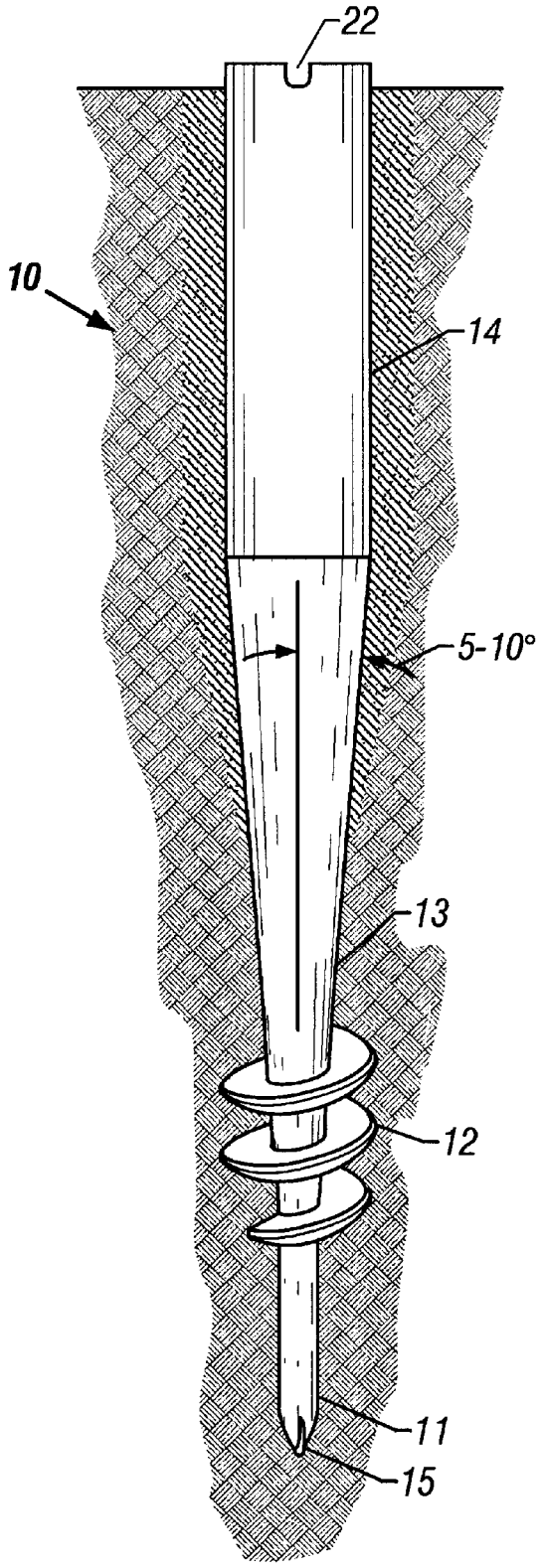

FIG. 1 is an elevational view of the preferred embodiment of the anchor device 10 of the present invention. The present invention is a screw-type, in-ground anchor device for receiving above ground uprights such as vertical posts, poles, or tubing. The device comprises a tip portion 11, flightings 12, a shallow-sloped conical portion 13, and a cylindrical upper housing portion 14 for receiving the above ground upright. The flightings have a diameter that is approximately equal to, but preferably slightly less than, the diameter of the upper housing portion. For example, in one embodiment designed for supporting fence posts, the outside diameter of the upper housing portion is 2⅞ inches and the diameter of the flightings is 2⅝ inches.

The flightings have a 1-inch spacing (i.e., 1-inch pitch) which causes the device to move ½ inch into the ground for each revolution. In the fence post embodiment, the flightings extend over a longitudinal distance of approximately 4-inches. The flightings are welded to the tip portion 11 and partially up the conical portion 13. The weld overlaps the tip of the conical portion to provide a stronger weld.

As the device is screwed into the ground, the conical portion 13 works as a packing device. The flightings 12 disrupt the soil only within the diameter of the upper housing portion 14, and the conical portion then outwardly compacts the soil to form a tightly packed soil shaft that tightly encloses the device 10 and holds it solidly in place. The conical portion has a shallow slope of less than 20 degrees, and preferably in the range of 5–10 degrees from the vertical. The shallow slope causes the soil to be compacted slowly as the device moves into the ground. Some looser soils may be compacted with conical slopes up to 20 degrees, but for denser soils, slopes of 5–10 degrees are preferable. Since the soil is being gradually compacted, less downward force must be generated by the flightings, thereby enabling the smaller flightings of the present invention to be utilized.

If the slope of the conical portion is steeper, as in some prior art devices, the flightings must generate more downward force in order to move the device through the ground and outwardly compact the soil in a shorter distance. Under these conditions, the smaller flightings utilized in the present invention would strip out the soil and spin uselessly in the hole. Prior art devices made the mistake of overcoming this problem by making the flightings larger so that they could produce more force. Prior art designers also had the mistaken belief that large flightings would provide a stable base for the device. However as noted above, large flightings have the detrimental effect of disrupting the soil in a large area surrounding the device as it moves into the ground, producing a less stable anchor. Therefore, reducing the diameter of the flightings to a diameter less than the outside diameter of the upper housing portion, and decreasing the slope of the conical section to less than 20 degrees produces the unexpected result of a more stable anchor.

Thus, the present invention provides the dual features of (1) disrupting the soil only within the diameter of the device itself, and (2) gradually compacting the disrupted soil outwardly as the device is pulled into the ground by the rotating flightings. In combination, these features result in a tightly packed soil shaft the exact diameter of the upper housing portion of the device.

The overall length of the device 10 is determined by the diameter and length of the vertical upright to be mounted in it, and the type of soil. For stability, the housing portion 14 should be long enough to accept about 25–30% of the length of the vertical upright. The length of the conical portion 13 is derived from the outside diameter of the upper housing portion (variable), the diameter of the tip portion (¾ inches), and the 5–10 degree slope of the cone. For the fence post embodiment, the conical portion is approximately 9 inches from the bottom of the housing portion 14 to the top of the tip portion 11.

The preferred embodiment of the present invention utilizes the tip portion 11 to provide vertical stability when the anchoring device is first started into the ground. In an alternative embodiment, the tip portion may be omitted, and the flightings attached to the lower part of the conical portion 13. However, without the tip portion, it is more difficult to keep the device plumb. The tip portion may be constructed by machining a point on a ¾-inch steel rod. In addition, one or two opposing vertical notches 15 are placed in the tip at the leading end to initially disrupt the soil in dense soil conditions, and to enable the tip to break up small rocks or dislodge them as the device penetrates the soil. Experimentation has shown that if the tip has a plain point, any impediment in the soil, such as a small rock, tends to deflect the anchoring device from the vertical as it is being inserted. When the tip is notched, however, the rock is either broken away or pushed to the side. If the tip hits the rough edge of a rock, the notch chips the rock, and the device remains plumb. Smooth rocks are pushed aside. As the device continues into the ground, the rock is pushed to the side by the conical portion, and does not affect the proper orientation of the device.

Additionally, if a plain tip hits an impediment such as a gas line, PVC water pipe, or electrical line, even though the object is smooth and rounded, the tip is likely to damage the pipe or line. However, when the notched tip hits a smooth rounded object such as a pipe or line, experimentation has shown that the tip pushes the pipe or line to the side and does not damage it.

In the fence post embodiment, the length of the rod making up the tip portion 11 is 5½ inches from the tip of the conical portion 13 to the leading end. The part of the tip portion that extends beyond the flightings is about 2½ inches. This configuration is for a tighter soil such as clay or black dirt. Sand, sandy loam, or gravel require different configurations with a longer tip. The longer tip provides more stability in looser soils.

Longer tip portions may also be used for anchor devices being inserted into lake bottoms or river beds. Uprights that go into a lake bottom or river bed currently have to be pile-driven into the soil under the lake or river. For most lake or river beds, there is a clay layer of the soil that actually holds the water, and the local water table is some distance below the clay layer. Accurate information about the depth of the water table is often not available, therefore, the distance from the bottom of the lake to the water table is not known. Pile driven poles driven into the bottom of a small pond may actually penetrate the clay layer, causing the pond to drain into the water table below.

The present invention, however, can be screwed into the lake bottom much quicker, and forms a plug in the underlying clay layer, thereby preventing the pond from being inadvertently drained. A coupling such as that described later in FIG. 6 may be utilized to attach the present invention to a drill. For different water depths, additional pipe sections may be added as required, much like drill stem pipe on an oil rig. For anchor devices designed for lake bottoms or river beds, the tip portion 11 may be as long as 12 or 13 inches. When the tip portion starts to penetrate the clay layer, the rotating flightings 12 screw into the clay soil, and the conical portion 13 tightly compacts the clay around the device. This creates a tight plug, providing a solid anchor for an upright while preventing the draining of the pond.

The diameter of the anchoring device may vary in order to support uprights of various diameters. For different diameters, the dimensions of the device are scaled up or down so that the anchor device retains approximately the same proportions. For example, while the conical portion of the fence post embodiment has a maximum outside diameter of 2⅞ inches and a length of 9 inches, a slightly larger version may have a maximum outside diameter of 3⅛ inches, and a conical portion 11 inches long, thus maintaining the slope of the conical portion at approximately 5–10 degrees. Known applications may vary from 2⅜ inches (inside diameter) for a fence post to 8 inches (inside diameter) for a street light or telephone pole. For highway signs, the inside diameter of the housing is approximately 4 inches.

For larger diameters such as 8 inches, it may be necessary to pre-drill a central bore hole due to the amount of soil to outwardly compact. The central bore hole may be as large as 6 inches in diameter and 24 inches deep. The depth of the central hole is less than the length of the device since the flightings 12 have to be screwed into the soil at the bottom of the bore hole in order to cause the compacting by the conical portion 13.

Uprights such as street lights commonly mount on a base plate. For uprights mounting on a base plate, the base plate is mounted on the top of the upper housing portion, and the street light, instead of being inserted into the housing, is mounted on the base plate.

The preferred embodiment of the anchoring device 10 is made of ¼-inch rolled steel, although the thickness and composition may vary according to the soil conditions and the size of the upright. The device may also be constructed of a hard polymer or a polymer/steel-strand mixture that can be formed in an injection mold. The preferred embodiment is hollow from the top of the upper housing portion 14 to the bottom tip of the conical portion 13. Alternatively, the conical portion may be solid, but it makes the device heavier and more expensive. In fact, for uses where a mounting plate is used on the top to mount uprights such as a light pole, the entire device may be solid, but once again, it makes the device heavier and more expensive.

Figure 2:
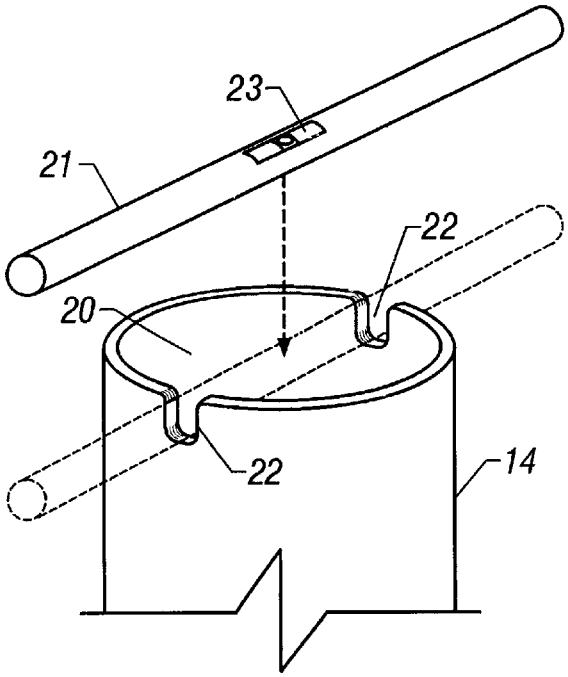
FIG. 2 is a perspective view of the top of the upper housing portion of the anchor device and a T-handle manual insertion tool.

The anchoring device can be inserted manually with an insertion tool or by machine. FIG. 2 is a perspective view of the top of the upper housing portion 14 of the anchor device, showing the void 20 formed inside the housing portion 14, and a T-handle manual insertion tool 21. The manual insertion tool may be a piece of pipe or steel rod that can be used as a T-handle when placed in the insertion slots 22 on the top of the housing. One or more people then rotate the device with the T-handle. A level indicator 23 may be mounted on the T-handle to ensure the anchoring device remains plumb.

Figure 3:
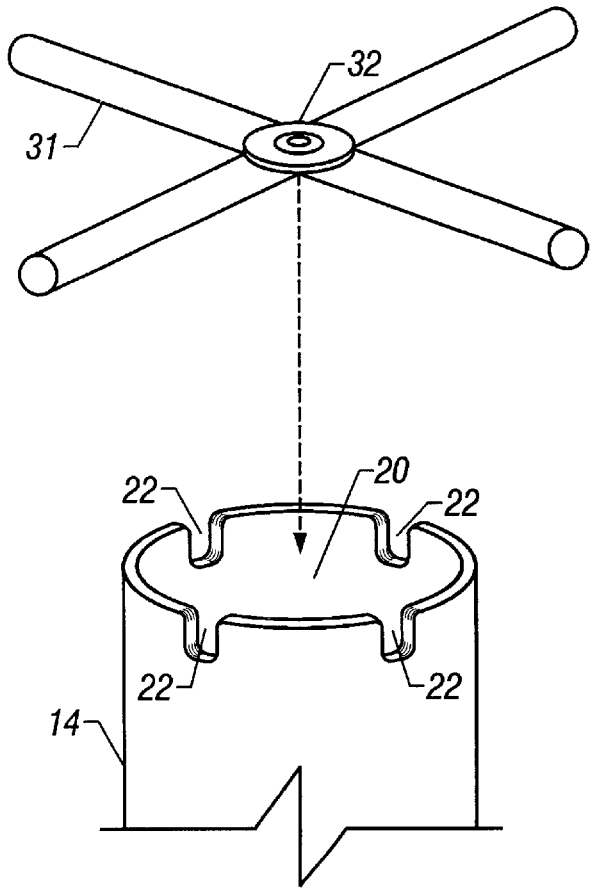
FIG. 3 is a perspective view of the top of the upper housing portion of the anchor device in an alternative embodiment and an X-handle manual insertion tool.

FIG. 3 is a perspective view of the top of the upper housing portion 14 of the anchor device in an alternative embodiment and an X-handle manual insertion tool 31. In this embodiment, the anchoring device 10 is provided with four insertion slots 22 on the top of the housing at 90-degree spacing. The X-handle is equipped with a leveling device which may be, for example, a circular bubble-level 32 mounted in the center of the X-handle. Alternatively, two opposing slots can be cut to a depth twice the diameter of the pipe, so that one T-handle can be placed in the deeper slots, and a second T-handle can be used in the shallow slots in a perpendicular orientation.

Figure 4:
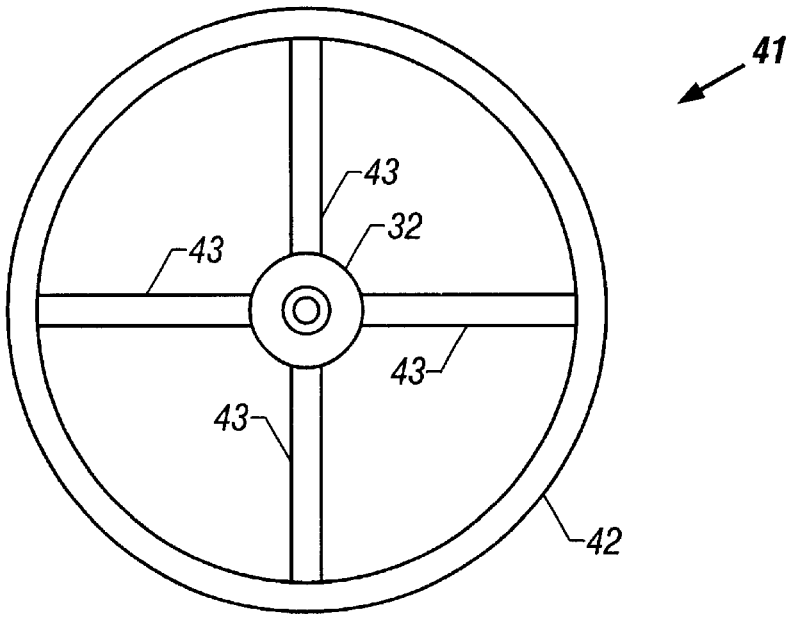
FIG. 4 is a top plan view of a first embodiment of a manual insertion wheel for use with the anchor device.

FIG. 4 is a top plan view of a first embodiment of a manual insertion wheel 41. In this embodiment, a loop 42 is mounted at the ends of a plurality of radiating spokes 43 to create a manual insertion handle similar to a steering wheel. Here again, a circular bubble-level 32 may be mounted in the center of the wheel to keep the anchoring device plumb as the device is inserted into the ground.

Figure 5:
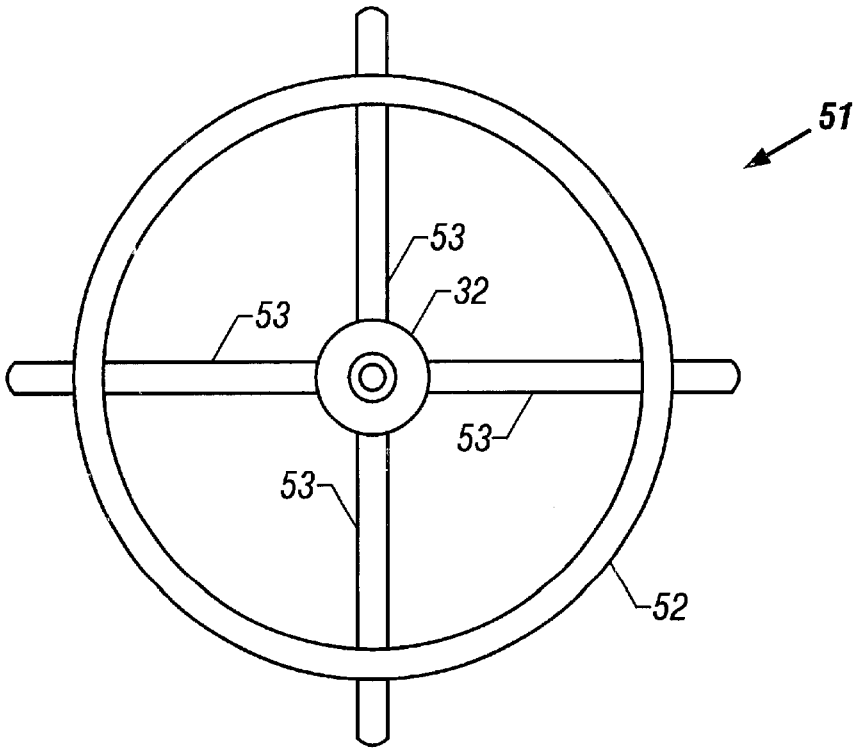
FIG. 5 is a top plan view of a second embodiment of a manual insertion wheel for use with the anchor device.

FIG. 5 is a top plan view of a second embodiment of a manual insertion wheel 51. In this embodiment, a loop 52 is mounted near the ends of a plurality of radiating spokes 53 to create a manual insertion handle similar to a ship's wheel. Here again, a circular bubble-level 32 may be mounted in the center of the wheel to keep the anchoring device plumb as the device is inserted into the ground.

Figure 6:
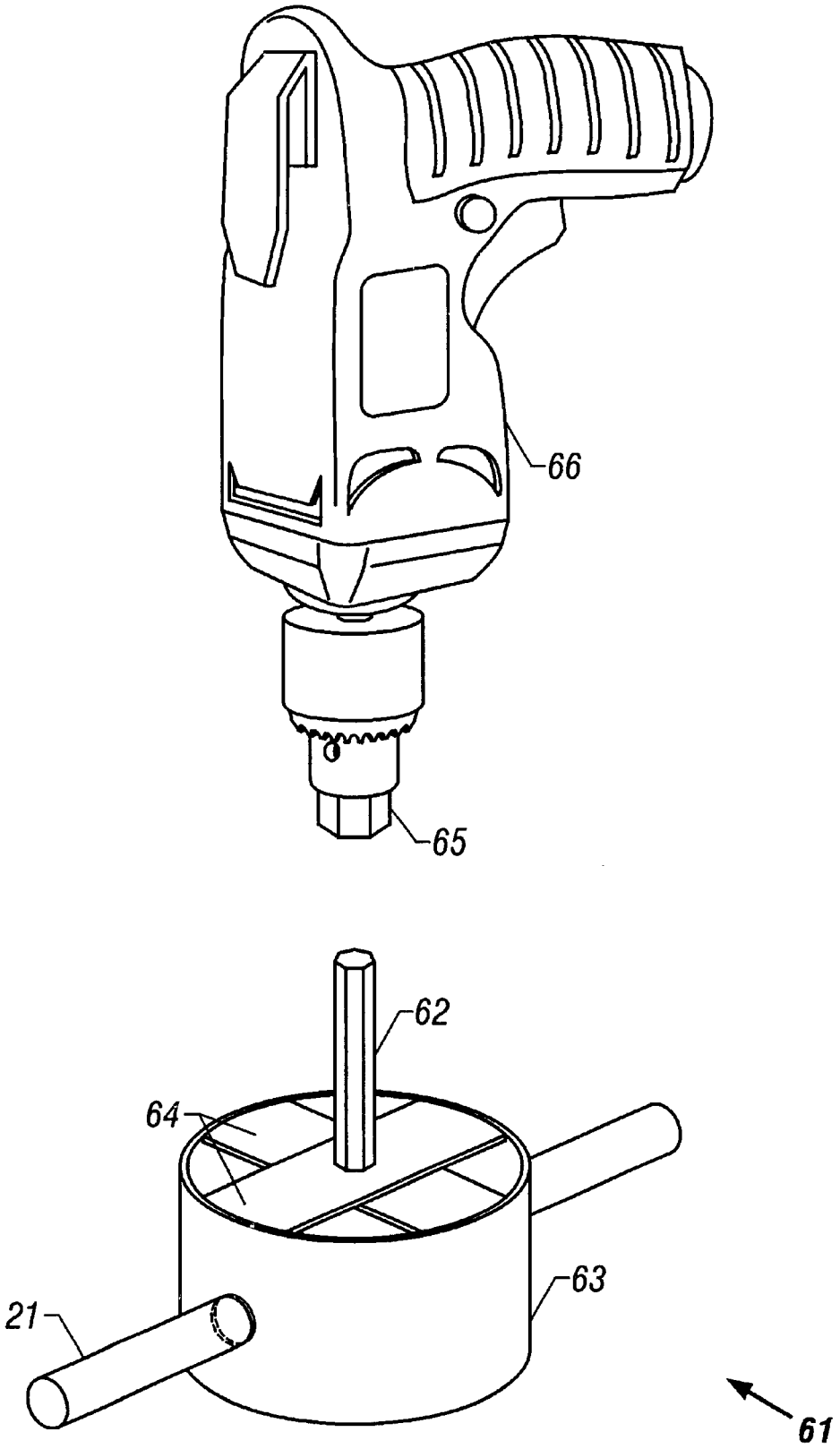
FIG. 6 is a perspective view of an adapter configured for use with a core drill chuck to mount a T-handle on a core drill for machine insertion of the anchor device into the ground.

FIG. 6 is a perspective view of an adapter 61 configured for use with a core drill chuck 65 to mount a T-handle similar to the T-handle 21 on a core drill 66 for machine insertion of the anchor device into the ground. For insertion by a machine, a hand-held or crane-mounted core drill 66 may be utilized to rapidly insert the device into the ground while reducing human labor. The adapter 61 includes a shank 62 which is inserted into the core drill chuck 65. The shank is mounted to a cylindrical body 63 with mounting brackets 64. The cylindrical body of the adapter has an outside diameter that is equal to the inside diameter of the upper housing portion 14 of the anchor device 10. In operation, the cylindrical body 63 is inserted into the upper housing portion 14, and the T-handle 21 is inserted into the insertion slots 22. The core drill is then used to insert the anchor device into the ground. Generally, a hand-held core drill may be used to insert anchoring devices up to approximately 3 inches in diameter. The crane-mounted core drill is preferable for larger diameters. A power takeoff (PTO) auger on a tractor can also be used to insert anchoring devices up to approximately 5 inches in diameter.

The anchoring device is reusable, and can be easily extracted from the ground and reinserted in a new location. This makes the device useful for temporary signage, fencing, or utility poles, etc. Reversing the direction of rotation causes the flightings 12 to back out until they reach the void created by the previous position of the conical portion 13. The device can then be simply lifted out of the hole.

It is thus believed that the operation and construction of the present invention will be apparent from the foregoing description. While the apparatus shown and described has been characterized as being preferred, it will be readily apparent that various changes and modifications could be made therein without departing from the scope of the invention as defined in the following claims.

What is claimed is:

1. A screw-type, in-ground anchor device for anchoring an above-ground upright, said anchor device comprising:

a generally cylindrical drive shaft comprising:

a cylindrical housing portion at an upper end of the drive shaft for supporting the above-ground upright, said housing portion having a first diameter;

a cylindrical tip portion at a bottom end of the drive shaft, said tip portion having a second diameter substantially less than the first diameter; and a shallow-sloped conical portion connecting the housing portion to the tip portion, said shallow-sloped conical portion including a surface with a diameter that decreases from the first diameter to the second diameter over a longitudinal distance that provides a slope to the surface of less than 20 degrees; and a set of screw threads (flightings) attached to the tip portion, the flightings having a maximum diameter that is equal to or less than the first diameter, said flightings operating in soil to screw the anchor device into the ground when the device is rotated, thereby creating a shaft of outwardly compressed soil tightly encasing the drive shaft in the ground.

2. The screw-type, in-ground anchor device of claim 1 wherein the slope of the surface of the shallow-sloped conical portion is approximately 5–10 degrees.

3. The screw-type, in-ground anchor device of claim 1 wherein the cylindrical housing portion is constructed of a rolled sheet of steel that forms a void for receiving a portion of the above-ground upright.

4. The screw-type, in-ground anchor device of claim 3 wherein the cylindrical housing portion includes at least one pair of opposing insertion slots in an upper edge thereof, and the anchor device further comprises an insertion tool for rotating the anchor device when placed in the insertion slots.

5. The screw-type, in-ground anchor device of claim 4 further comprising an adapter for mounting the insertion tool in a drill for machine rotation of the anchor device and insertion of the anchor device into the ground.

6. The screw-type, in-ground anchor device of claim 1 wherein the tip portion includes a lower pointed end, said lower end having at least one vertical notch therein, said vertical notch initially disrupting the soil in dense soil conditions, and moving impediments from in front of the anchor device during insertion into the ground.

7. The screw-type, in-ground anchor device of claim 1 wherein the flightings extend from approximately a midpoint of the tip portion up to a bottom part of the conical portion.

8. The screw-type, in-ground anchor device of claim 7 wherein the flightings have a 1-inch pitch.

9. The screw-type, in-ground anchor device of claim 1 wherein the tip portion has a length, and the length varies depending on the type of soil in which the device is inserted.

10. The screw-type, in-ground anchor device of claim 9 wherein the length of the tip portion is longer in softer soils and is shorter in harder soils.

11. A screw-type, in-ground anchor device for anchoring an above-ground upright when the device is screwed into soil, said anchor device comprising:

a generally cylindrical drive shaft comprising:

a cylindrical housing portion at an upper end of the drive shaft for supporting the above-ground upright, said housing portion having a first outside diameter and being constructed of a rolled sheet of steel that forms a void for receiving a portion of the above-ground upright therein, said housing portion including at least one pair of opposing insertion slots in an upper edge thereof;

a cylindrical tip portion at a bottom end of the drive shaft, said tip portion having a second outside diameter substantially less than the first outside diameter, said tip portion including a lower pointed end with at least one vertical notch therein, said vertical notch initially disrupting the soil in dense soil conditions, and moving impediments from in front of the anchor device during insertion into the ground; and a conical portion connecting the housing portion to the tip portion, said conical portion having an outer surface with an outside diameter that decreases from the first outside diameter to the second outside diameter over a longitudinal distance that provides a slope to the surface of approximately 5–10 degrees;

a set of screw threads (flightings) attached to the tip portion, the flightings having a maximum diameter that is approximately equal to or less than the first outside diameter, said flightings having a 1-inch pitch and extending from approximately a midpoint of the tip portion up to a bottom part of the conical portion; and an insertion tool for inserting the anchoring device into the ground by rotating the anchor device when placed in the insertion slots.

12. A screw-type, in-ground anchor device for anchoring an above-ground upright in all types of soil, said anchor device comprising:

a hollow cylindrical upper housing portion having an outside diameter and an inside diameter sized to accept the above-ground upright;

a set of flightings near a bottom end of the anchor device that impart downward force on the anchor device when the anchor device is rotated, said flightings having a maximum diameter approximately equal to or less than the outside diameter of the housing portion, said flightings disrupting the soil in their wake; and a conical portion in the wake of the flightings and prior to the housing portion that outwardly compresses the soil disrupted by the flightings, said conical portion having a slope of less than 20 degrees;

whereby outward compression of the soil creates a tightly compressed soil shaft having an inside diameter equal to the outside diameter of the housing portion, said compressed soil shaft tightly encasing the drive shaft in the ground.

13. The screw-type, in-ground anchor device of claim 12 wherein the slope of the conical portion is approximately 5–10 degrees.

14. A screw-type, in-ground anchor device for anchoring an above-ground upright, said anchor device comprising:

a generally cylindrical drive shaft comprising:

a hollow cylindrical housing portion at an upper end of the drive shaft for supporting the above-ground upright when said upright is inserted into the housing portion, said housing portion having an outside diameter; and a shallow-sloped conical portion connected to the housing portion; and a set of screw threads (flightings) attached to the conical portion, the flightings having a maximum diameter that is equal to or less than the outside diameter of the housing portion, said flightings operating in soil to screw the anchor device into the ground when the device is rotated, thereby creating a shaft of outwardly compressed soil tightly encasing the drive shaft in the ground.

15. The screw-type, in-ground anchor device of claim 14 wherein the shallow-sloped conical portion includes a surface with a diameter that decreases from the outside diameter of the housing portion to a point over a longitudinal distance that provides a slope to the surface of less than 20 degrees.

16. The screw-type, in-ground anchor device of claim 14 wherein the shallow-sloped conical portion includes a surface with a diameter that decreases from the outside diameter of the housing portion to a point over a longitudinal distance that provides a slope to the surface of approximately 5–10 degrees.

* * * * *